US010039351B2

(12) United States Patent
Allen

(10) Patent No.: US 10,039,351 B2
(45) Date of Patent: Aug. 7, 2018

(54) BREAKAWAY CLASP

(71) Applicant: CRAYOLA, LLC, Easton, PA (US)

(72) Inventor: James Allen, Nazareth, PA (US)

(73) Assignee: Crayola, LLC, Easton, PA (US)

( * ) Notice: Subject to any disclaimer, the term of this patent is extended or adjusted under 35 U.S.C. 154(b) by 0 days.

(21) Appl. No.: 15/382,301

(22) Filed: Dec. 16, 2016

(65) Prior Publication Data

US 2017/0172264 A1 Jun. 22, 2017

Related U.S. Application Data

(60) Provisional application No. 62/268,716, filed on Dec. 17, 2015.

(51) Int. Cl.
*A44C 5/20* (2006.01)
*A44C 5/00* (2006.01)
(Continued)

(52) U.S. Cl.
CPC ..... *A44C 5/2076* (2013.01); *A44B 11/25* (2013.01); *A44C 5/0053* (2013.01);
(Continued)

(58) Field of Classification Search
CPC ..... A44C 5/2076; A44C 5/0069; A44C 5/185; Y10T 24/45178; Y10T 24/45775;
(Continued)

(56) References Cited

U.S. PATENT DOCUMENTS 597,828 A 1/1898 Gates
1,791,567 A 2/1931 Meyer
(Continued)

FOREIGN PATENT DOCUMENTS

DE 2252073 A1 * 5/1974 ..... A44B 5/02

OTHER PUBLICATIONS

Crayola Jewel Maker by BSCkids (via YouTube.com), available Mar. 20, 2016, [online], [site visited Dec. 11, 2017]. Video available from internet, https://www.youtube.com/watch?v=h-YzSq5Ombl.
(Continued)

*Primary Examiner* — Robert Sandy
*Assistant Examiner* — Michael S Lee
(74) *Attorney, Agent, or Firm* — Shook, Hardy & Bacon, L.L.P.

(57) ABSTRACT

A breakaway clasp having two clasp components that can be releasably coupled together to provide a quick release closure mechanism. A first clasp component having a coupling portion and an attachment portion, and an identical second clasp component having a coupling portion and an attachment portion. The attachment portions may be configured to be coupled to a portion of an article, such as a necklace or bracelet, and the coupling portions are configured to releasably couple to each other, thereby forming a closure. Each coupling portion comprising two, identical hemisphere elements and a connecting section that connects the two hemisphere elements. The hemisphere elements and connecting section may define a receiving cavity configured to receive at least a portion of the hemisphere elements of the other clasp component.

16 Claims, 8 Drawing Sheets

(51) Int. Cl.

| | |
|---|---|
| ***A44C 5/18*** | (2006.01) |
| ***A63H 33/30*** | (2006.01) |
| ***D04B 5/00*** | (2006.01) |
| ***D04B 3/02*** | (2006.01) |
| ***A44B 11/25*** | (2006.01) |

(52) U.S. Cl.
CPC ..... *A44C 5/0069* (2013.01); *A44C 5/185* (2013.01); *A63H 33/3088* (2013.01); *D04B 3/02* (2013.01); *D04B 5/00* (2013.01); *A44D 2200/12* (2013.01); *Y10T 24/45178* (2015.01); *Y10T 24/45775* (2015.01)

(58) Field of Classification Search
CPC ..... Y10T 24/45152; Y10T 24/45173; Y10T 24/314; Y10T 24/344; Y10T 24/44; Y10T 24/3439; Y10T 24/45225; Y10T 24/4736; Y10T 24/4745; Y10T 24/45183; Y10T 24/45267; A44B 18/0053; A63H 17/264; A44D 2200/12
USPC ..... 63/3.1
See application file for complete search history.

(56) References Cited

U.S. PATENT DOCUMENTS

| | | | | |
|---|---|---|---|---|
| 2,303,267 | A | 11/1942 | Goodwin | |
| D135,873 | S | 6/1943 | Chernow | |
| 2,389,295 | A | 11/1945 | Chernow | |
| D153,610 | S | 5/1949 | Kline | |
| D154,074 | S | 6/1949 | Spear | |
| D154,075 | S | 6/1949 | Spear | |
| 2,510,511 | A | 6/1950 | Mittendorf | |
| 2,620,795 | A | 12/1952 | Muhlethaler | |
| 2,797,605 | A * | 7/1957 | Metze, Jr. | F16B 33/02 402/48 |
| 2,948,038 | A | 8/1960 | Benda | |
| D199,996 | S | 1/1965 | Pintarelli | |
| D302,242 | S | 7/1989 | Belash | |
| 5,366,475 | A | 11/1994 | Voss et al. | |
| 5,464,413 | A | 11/1995 | Siska, Jr. et al. | |
| D368,589 | S | 4/1996 | Guio | |
| D375,552 | S | 11/1996 | Davi | |
| D449,561 | S | 10/2001 | Krieger | |
| D459,806 | S | 7/2002 | Webb | |
| D459,807 | S | 7/2002 | Webb | |
| 6,427,292 | B1 * | 8/2002 | Seifert | A45C 13/30 24/265 EC |
| D476,263 | S | 6/2003 | Walters | |
| 6,718,112 | B1 | 4/2004 | Rodriguez et al. | |
| D492,869 | S | 7/2004 | Henry | |
| D522,650 | S | 6/2006 | Clawson | |
| D592,508 | S | 5/2009 | Perignon | |
| D592,509 | S | 5/2009 | Lecoutre | |
| D599,520 | S | 9/2009 | Boesi et al. | |
| D616,559 | S | 5/2010 | Boyer | |
| D623,306 | S | 9/2010 | Boyer | |
| D667,752 | S | 9/2012 | Leclerc | |
| D669,977 | S | 10/2012 | Chiang | |
| D670,396 | S | 11/2012 | Doogan | |
| D674,590 | S | 1/2013 | Busch | |
| 8,376,752 | B2 | 2/2013 | McDevitt | |
| D704,823 | S | 5/2014 | Rindner | |
| D719,662 | S | 12/2014 | Pope | |
| D732,009 | S | 6/2015 | Bak | |
| D732,425 | S | 6/2015 | Ng | |
| D732,683 | S | 6/2015 | Zhang | |
| D732,997 | S | 6/2015 | Comolli | |
| D739,519 | S | 9/2015 | Davi | |
| D744,646 | S | 12/2015 | Nering et al. | |
| D763,066 | S | 8/2016 | Sugimoto | |
| D802,152 | S | 11/2017 | Wakefield et al. | |
| D804,666 | S | 12/2017 | Guo et al. | |
| 2002/0124844 | A1 | 9/2002 | Chiang | |
| 2009/0054923 | A1 | 2/2009 | Benson | |
| 2009/0206120 | A1 | 8/2009 | Komazaki et al. | |
| 2011/0023872 | A1 | 2/2011 | Evans | |
| 2012/0246893 | A1 * | 10/2012 | Martellotti | B65H 75/14 24/596.1 |
| 2013/0150658 | A1 | 6/2013 | Miledi | |
| 2017/0173490 | A1 * | 6/2017 | Allen | A63H 33/3088 |

OTHER PUBLICATIONS

Toy Fair 2016 Crayola DIY Jewelry Maker Kit First Look by FunToySurprises (via YouTube.com), available Feb. 16, 2016, [online], [site visited Dec. 11, 2017]. Video available from internet, https://www.youtube.com/watch?v=BO5N5wxl1Xc, https://www.youtube.com/watch?v=BO5N5wxl1Xc.

Crayola Jewel Maker (via amazon.com), available Jul. 1, 2016, [online], [site visited Dec. 11, 2017]. Available from internet, https://www.amazon.com/Crayola-Creative-Activity-Create-Jewelry/dp/B01CIMC7R6/ref=sr_1_1?ie=UTF8&qid=1527173202&sr=8-1&keywords=Crayola+Jewel+Maker, https://www.amazon.com/Crayola-Creative-Activity-CreateJewelry/dp/B01CIMC7R6/ref=sr_1_1?ie=UTF8&qid=1527173202&sr=8-1&keywords=Crayola+Jewel+Makemo.

* cited by examiner

BREAKAWAY CLASP

CROSS-REFERENCE TO RELATED APPLICATIONS

This application claims priority to U.S. Provisional Application No. 62/268,716, entitled "TOY KNITTING DEVICE," filed on Dec. 17, 2015, which is incorporated by reference in its entirety.

SUMMARY

Embodiments of the invention are defined by the claims below, not this summary. A high-level overview of various aspects of the invention provides an overview of the disclosure and introduces a selection of concepts that are further described in the detailed description section below. This summary is not intended to identify key or essential features of the claimed subject matter or to be used as an aid in isolation to determine the scope of the claimed subject matter.

In brief and at a high level, this disclosure describes, among other things, a toy knitting device designed to create a tubular knitted product. In one aspect, the knitting device comprises a knitting body and a knitting base with an arm connecting the base to the knitting body. The knitting body may include an interior chamber and a needle holder rotatably mounted within the interior chamber. The needle holder may have a center aperture and a plurality of needles slidably coupled to the needle holder. As the needle holder rotates around the center aperture, the needles may alternate moving vertically along the side of the needle holder to grasp a knitting strand that has been fed into the interior chamber of the knitting body. As the needles rotate, they knit a knitted product from the knitting strand, and the knitted product passes through the center aperture and is discharged from the interior chamber of the knitting body. The rotation of the needle holder may be created by a plurality of engaged gears coupled to either a hand knob or crank for manual rotation or to an automated motor for automated rotation. The knitting device may also include a knitting-body cover configured to protect the plurality of needles on the needle holder while permitting travel of the knitting strand into the interior chamber of the knitting body.

The knitting device may also be configured to incorporate embellishments or other objects within the knitted product. Accordingly, the center aperture of the needle holder may be configured to receive the embellishment or other object while the needles knit the knitted product around the embellishment or other object. Additionally, the knitting-body cover may have an opening corresponding to the center aperture that permits travel of the embellishment or other object into the interior chamber while the knitting-body cover is closed.

In some embodiments, the knitting device may be a part of a knitting kit that also comprises a breakaway clasp. The breakaway clasp may be configured to couple both ends of the knitted product created by the knitting device to create a finished product, such as a bracelet or a necklace. The breakaway clasp may comprise of two identical clasp components that are configured to releasably couple to each other.

DESCRIPTION OF THE DRAWINGS

Illustrative embodiments of the invention are described in detail below with reference to the attached drawing figures, and wherein.

DETAILED DESCRIPTION

Figure 1:
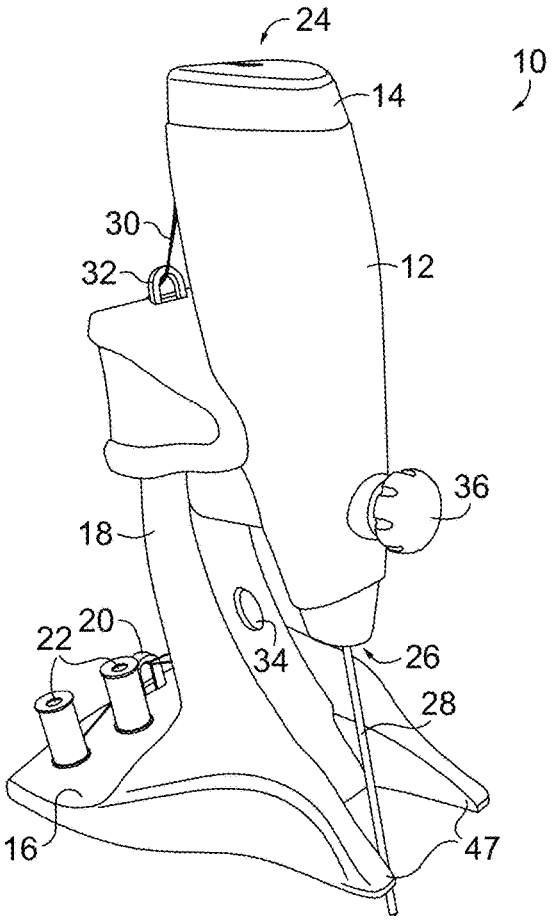
FIG. 1 is a right, front perspective view of a knitting device, in accordance with an embodiment of the invention.

The subject matter of embodiments of the invention is described with specificity herein to meet statutory requirements. But the description itself is not intended to necessarily limit the scope of the claims. Rather, the claimed subject matter might be embodied in other ways to comprise different steps or combinations of steps similar to the ones described in this document, in conjunction with other present or future technologies. Terms should not be interpreted as implying any particular order among or between various disclosed steps unless and except when the order of individual steps is explicitly described.

Embodiments of the invention include, among other things, a knitting device for making a knitted product, the knitting device comprising: a knitting body having an interior chamber, a material-insertion end, and a material-exit end; a knitting base coupled to the knitting body, said base comprising an arm coupling the knitting body to the knitting base; a knitting-body cover coupled to at least a portion of the knitting body at the material-insertion end of the knitting body; a plurality of engaged gears; and a ring cam. The knitting body may comprise: a needle holder rotatably mounted in association with the interior chamber of the knitting body, the needle holder having a center aperture; a plurality of needles slidably coupled to the needle holder, wherein the plurality of needles are coaxially aligned with the interior chamber of the knitting body and the center aperture; and a contoured edge surrounding the interior chamber at the material-insertion end of the knitting body. The plurality of engaged gears may extend between the needle holder and at least one rotation-initiation point, wherein rotation of the plurality of engaged gears may rotate the needle holder around the center aperture. The ring cam may have a contoured edge abutting the plurality of needles on the needle holder. As the needle holder rotates, the plurality of needles may move along the contoured edge of the ring cam, causing the plurality of needles to move along a vertical axis and grasp a knitting strand being fed into the knitting body to create a knitted product that is discharged through the center aperture of the needle holder and out of the interior chamber of the knitting body at the material-exit end of the knitting body.

Embodiments of the invention also include an automated knitting device comprising: a knitting body having a hollow interior; a knitting base having a positioning guide and an arm coupling the knitting body to the knitting base; a ring cam; and an automated rotational system. The knitting body may include: a needle holder rotatably mounted in the interior chamber of the knitting body, the needle holder having a center aperture; and a plurality of needles slidably coupled to the needle holder, wherein the plurality of needles are coaxially aligned with the interior chamber of the knitting body. The ring cam may have a contoured edge abutting the plurality of needles configured to rotate the needle holder. The automated rotational system may be configured to rotate the needle holder and may comprise an automated motor, a plurality of engaged gears between the automated motor and the needle holder, and a rotation-initiation button on the arm of the knitting device to turn on the automated motor. Rotation of the needle holder may move the plurality of needles along the contoured edge of the ring cam, causing the plurality of needles to move along a vertical axis and grasp a knitting strand being fed into the knitting body to create a knitted product that is discharged through the center aperture of the needle holder and out of the interior chamber of the knitting body at a material-exit end of the knitting body.

Another embodiment comprises a knitting kit comprising a knitting device and a breakaway clasp for coupling a first end of a knitted product to a second end of the knitted product. The knitting device of the knitting kit may include a knitting body having an interior chamber, a material-insertion end, and a material-exit end. The knitting body may further include: a needle holder rotatably mounted in the interior chamber of the knitting body, the needle holder having a center aperture; a plurality of needles slidably coupled to the needle holder, wherein the plurality of needles are coaxially aligned with the interior chamber of the knitting body; and a contoured edge surrounding the interior chamber at the material-insertion end of the knitting body. The plurality of needles may be configured to knit a knitted product in response to repeated rotation of the plurality of needles upon coupling of the plurality of needles to at least one knitting strand, wherein the knitted product comprises a diameter corresponding to the center aperture and a hollow interior configured to cover at least one embellishment inserted into the hollow interior.

The knitting device of the knitting kit may also include a knitting base having an arm coupling the knitting body to the knitting base and a knitting-body cover coupled to the knitting body at the material-insertion end of the knitting body. The knitting-body cover may be configured to permit travel of the at least one knitting strand through the interior chamber of the knitting body.

Further embodiments include a clasp comprising a first clasp component and a second clasp component. The first clasp component and the second claps component may each have a coupling portion and an attachment portion. Each coupling portion may comprise two hemisphere elements and a connecting section that connects the two hemisphere elements and may be configured to releasably couple the first clasp component to the second clasp component. Each attachment portion may be configured to be coupled to a portion of an article.

In another embodiment, a universal clasp component comprise a first hemisphere element, a second hemisphere element, and a connecting section connecting the first hemisphere element and the second hemisphere element. The universal clasp component may also include an attachment portion adjacent the connecting section. The attachment portion may be configured to attach the universal clasp component to an article, such as jewelry, garments, or other items. At least a portion of the first hemisphere element, at least a portion of the second hemisphere element, and the connecting section may define a receiving cavity configured to receive at least a portion of a second universal clasp component.

In yet another embodiment, a symmetrical clasp component for a closure mechanism comprises a first hemisphere element and a second hemisphere element opposite the first hemisphere element. The first hemisphere element and the second hemisphere element each comprising a convex shape and extending towards one another, and the first hemisphere element may comprise a mirror image of the second hemisphere element The symmetrical clasp component may also include a connecting section having a first end connected to the first hemisphere element and a second end connected to the second hemisphere element. The connecting section may form a hinge between the first hemisphere element and the second hemisphere element. At least a portion of the first hemisphere element, at least a portion of the second hemisphere element, and the connecting section may define a receiving cavity.

With reference now to the figures, an apparatus for a knitting device and a knitting kit are described in accordance with embodiments of the invention. Various embodiments are described with respect to the figures in which like elements are depicted with like reference numerals.

Figure 2:
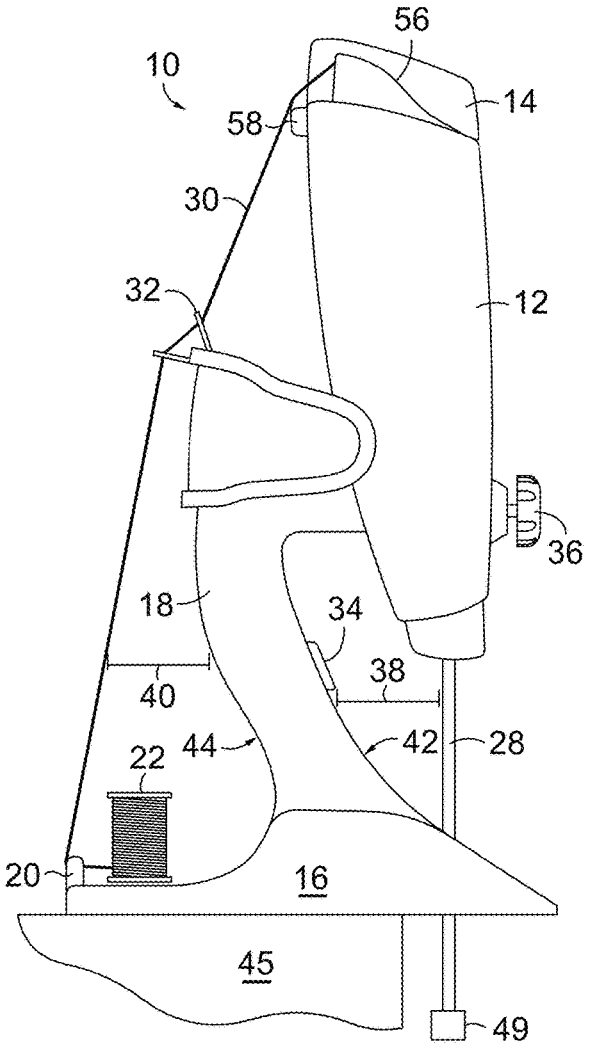
FIG. 2 is a side view of the knitting device of FIG. 1, in accordance with an embodiment of the invention.
Figure 3:
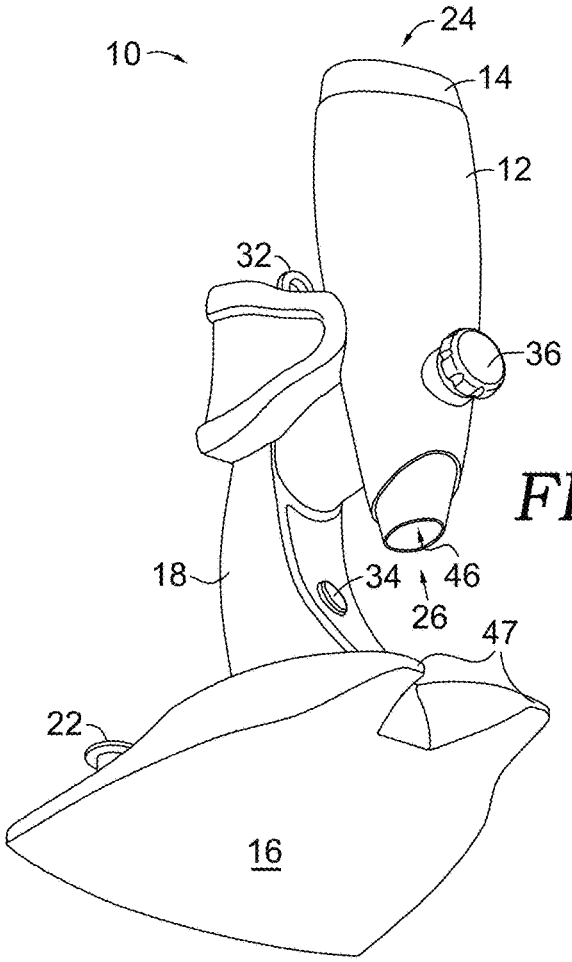
FIG. 3 is a bottom, front perspective view of the knitting device of FIG. 1, in accordance with an embodiment of the invention.

As depicted in FIGS. 1-3, embodiments of the invention include a knitting device 10 that comprises a knitting body 12 and a knitting base 16 that has an arm 18 connecting the knitting body 12 to the rest of the knitting base 16. FIGS. 1-3 provide a right, front perspective view, a side view, and a bottom, front perspective view of an embodiment of the knitting device 10, respectively. In an embodiment, the knitting body 12 may comprise a cylindrical shape having a hollow interior chamber 46 (not shown in FIGS. 1-2), but other embodiments may comprise other shapes of the knitting body 12. The knitting body 12 may also have a material-insertion end 24 and a material-exit end 26.

The knitting device 10 may be configured to produce a knitted product from material inserted into the knitting body 12 at the material-insertion end 24. For example, a knitting strand 30 inserted into the knitting body 12 at the material-insertion end 24 may be mechanically knitted by the knitting device 10 prior to exiting at the material-exit end 26. As will be described in greater detail below, the knitting device 10 knits one or more knitting strands 30 into a knitted product 28 with a plurality of needles (shown in FIG. 4), and the knitted product 28 is discharged from interior chamber 46 of the knitting body 12 at the material-exit end 26, according to some embodiments of the invention. The discharged product creates a stream of knitted product 28 while exiting the knitting body 12.

Various types of material may be used in the knitting device 10, including polyester, nylon, wool, cotton, and the like. In an exemplary embodiment, the material is in a thread or yarn form. A knitting strand 30 of the thread or yarn may be fed into the knitting body by hand, or may be guided from the knitting base 16 to the material-insertion end 24 of the knitting body 12. The knitting strand 30 may be secured to the knitting base 16 by a plurality of spool holders 22 on the knitting base 16. In one embodiment, there may be four spool holders 22 on the knitting base 16. The knitting strand 30 from any spool holder 22 may run through a positioning guide 20 on the knitting base 16 and up through a thread guide 32 on the arm 18 up towards the material-insertion end 24 of the knitting body 12. Multiple knitting strands 30 from different spool holders 22 may simultaneously be guided to the knitting body 12

In some embodiments, the knitting device 10 is automated so that an automated motor (not shown) is used to rotate the plurality of needles to knit the knitting strand 30. The automated motor may be turned on with an automated rotation-initiation mechanism 34 that is at least partially on an external location of the knitting device 10. The automated rotation-initiation mechanism 34 may comprise a button, a switch, or the like that initiated the automated motor when engaged.

The knitting device 10 may also work by manual rotation of the plurality of needles. A rotational hand knob 36 may be used to manually rotate the plurality of needles. In some aspects, the rotational hand knob 36 may comprise a hand crank. Manual rotation by the rotational hand knob 36 may allow knitting of the knitting strand at a user-determined rate rather than at a pre-determined automated rate. In some embodiments, the knitting device 10 may work with both an automated motor for automated rotation and a rotational hand knob 36 for manual rotation. For example, in one aspect, rotation of the rotational hand knob 36 may cease or override the automated motor in the automated rotational system.

The arm 18 of the knitting device 10 may be curved so that the arm 18 forms a convex shape with respect to the knitting body 12. In some embodiments, the curve of the arm 18 may create optimal placement of the knitting strand 30 and the stream of knitted product 28 with respect to arm 18 for purposes of safe access to the arm 18. For instance, the automated rotation-initiation mechanism 34 may be located on a first surface 42 of the arm 18 generally facing the stream of knitted product 28, but the curve of the arm 18 would set back the rotation-initiation mechanism 34 to provide access to the rotation-initiation mechanism 34 while avoiding contact with the stream of knitted product 28. Accordingly, the curve of the arm 18 creates a distance 38 between the rotation-initiation mechanism 34 and the stream of knitted product 28 that is sufficient to allow a user to access the rotation-initiation mechanism 34 while avoiding the stream of knitted product 28. Similarly, when the knitting strand 30 runs from the positioning guide 20 on the knitting base 16 to the thread guide 32 on the arm 18, the knitting strand 30 may form a triangular-like shape with the arm 18 and the knitting base 16. Again, the curve of the arm 18 may maintain a distance 40 between the knitting strand 30 and a second surface 44 of the arm 18 generally facing away from the stream of knitted product 28 that is sufficient for a user to grab the arm 18 while safely avoiding contact with the knitting strand 30 extending from the positioning guide 20 and the thread guide 32.

The curve of the arm 18 may also provide optimal weight distribution during the knitting process, according to some embodiments of the invention. As the knitting device 10 may create long strands of the knitted product 28, the user may wish to place the knitting device 10 at the edge of a flat work surface 45 while knitting. By using the knitting device 10, the knitting body 12 may be positioned over the edge of the work surface 45 so that the stream of knitted product 28 discharged from the knitting body 12 may fall past the work surface 45 and remain in a straight configuration during knitting, rather than being coiled on the work surface 45. As shown in FIGS. 1-3, the knitting base 16 may include two legs 47 that extend from the knitting base 16 and, at least partially, extend past the edge of the work surface 45, with sufficient space between the legs 47 through which the stream of the knitted product 28 may pass. Additionally, in some embodiments, a weighted object 49 may be attached to the end of the knitted product 28 as it is being discharged from the knitting body 12. The additional weight from the weighted object 49 creates tension on the knitted product 28 to ensure the knitted product 28, which may generally be lightweight, is being discharged at a rate sufficient to accommodate the rate of knitting. In alternative embodiments, the knitted product 28 may be gently pulled by the user to maintain a sufficient discharge rate instead of using the weighted object 49.

Without the curve of the arm 18, the weight of the knitting body 12, the stream of knitted product 28, and the weighted object 49 over the edge of the work surface could create an unbalanced weight distribution such that the knitting device 10 would have a tendency to fall off the work surface 45. However, the curve of the arm 18 may help to counter balance the weight of the knitting device 10 that is over the edge of the work surface 45 to keep the knitting device 10 stable.

Figure 4:
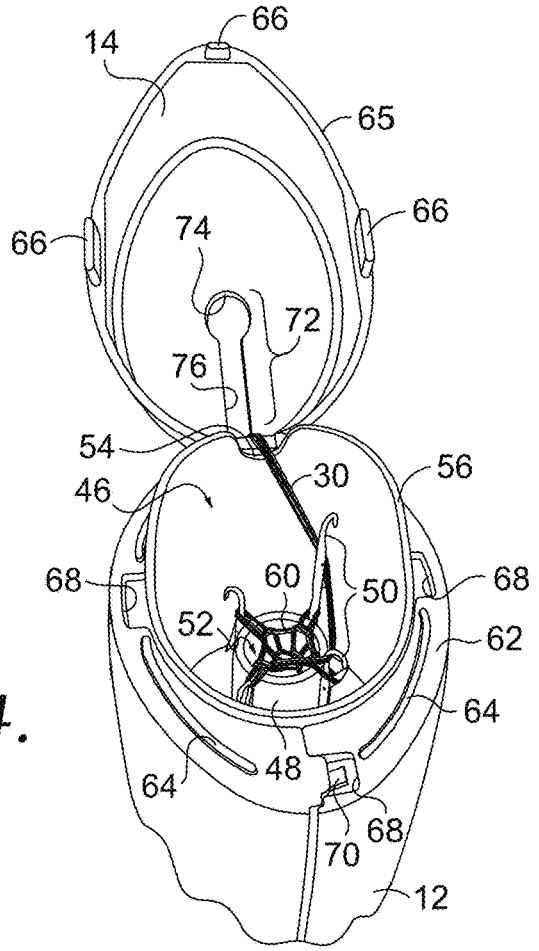
FIG. 4 is an expanded, perspective view of the top of the knitting device of FIG. 1 with a knitting-body cover in an open position, in accordance with an embodiment of the invention.

Turning to FIG. 4, an expanded, perspective view of the top of the knitting device 10 in accordance with an embodiment is provided. Within the interior chamber 46 of the knitting body 12, there may be a needle holder 48 with a center aperture 52. The needle holder 48 may be rotatably mounted to the knitting body 12 so that it may rotate within the interior chamber 46. In an embodiment, a plurality of needles 50 may be coupled to the needle holder 48 so that the needles 50 are evenly spaced and coaxially aligned with the interior chamber 46 of the knitting body 12. The needles 50 may be slidably coupled to the needle holder 48. When the needles are slidably coupled to the needle holder 48, they may be able to individually slide or move vertically with respect to the needle holder 48. In the embodiment illustrated in FIG. 4, there are four needles 50 around the needle holder 48, but some embodiments may have more or less needles 50.

The knitting strand 30 may be fed into the interior chamber 46 of the knitting body 12 by a thread feeder 54. In the embodiment shown, the thread feeder 54 is a U-shaped indention on a raised edge 56 of the knitting body 12 at the material-insertion end 24. The thread feeder 54 may be positioned on the knitting body 12 to generally align with the thread guide 32 on the arm 18. As illustrated in FIG. 2, there may also be a thread extender 58 extending from a thread-facing surface on the knitting body 12 near a knitting-body cover 14. The thread extender 58 keeps the knitting strand 30 away from the knitting body 12 as it runs through the thread feeder 54 and into the interior chamber 46 of the knitting body 12. Maintaining the knitting strand 30 at a distance from the knitting body 12 creates an angle of insertion of the knitting strand 30 into the interior chamber 46 that allows for smoother movement of the knitting strand 30 into the interior chamber 46 with less tension.

Turning back to FIG. 4, once the knitting strand 30 is fed into the interior chamber 46, the needle holder 48 may be rotated, via automated or manual rotation, so that the needles 50 may alternate in grabbing the knitting strand 30 to form a knitted structure 60. In some embodiments, starting the knitted structure 60 may occur by having every other needle 50 grab the knitting strand 30 until every other needle 50 catches the knitting strand 30 and then having every needle 50 alternate in grabbing the knitting strand 30. As the needles 50 continue to knit the knitted structure 60, the knitted product 28 will be formed. In some embodiments, initializing the knitted structure 60 may be better suited with manual rotation of the needle holder 48 while automated rotation may be forming the majority of the knitted product 28. Accordingly, when beginning the knitted structure 60, a user may manually rotate the needle holder 48 while manually advancing the knitting strand 30 into engagement with each needle in the circular path. Once the knitting strand 30 is engaged with each needle a minimum number of times, the user may discontinue manual rotation of the device and continue knitting the knitted product 28 using the automated rotation method. As the knitted product 28 forms, the knitted product 28 may move through the center aperture 52 of the needle holder, which opens up into the interior chamber 46 of the knitting body 12.

Though not shown, it is contemplated that the rotation of the needle holder 48 may operate through a plurality of gears. A plurality of engaged gears may extend between the needle holder 48 and a rotation-initiation point. The rotation-initiation point may be the automated motor with an external initiation mechanism, such as the automated rotation-initiation mechanism 34, or may be a manual rotation mechanism, such as the rotational hand knob 36. In some aspects, there may be two separate sets of gears: one for automated rotation and one for manual rotation. In other aspects, automated rotation and manual rotation may be provided for by at least part of the same gears.

Rotation of the plurality of engaged gears in turn rotates the needle holder 48 around the center aperture 52. As the needle holder 48 rotates, the plurality of needles 50 will alternate sliding up and down on the surface of the needle holder 48. While not shown, various mechanisms, such as a cam system, may be used to move the needles 50 up and down. For example, a ring cam having a contoured edge may abut at least a portion of the plurality of needles. As the needle holder 48 rotates, the plurality of needles may move along the contoured edge of the ring cam. When a needle moves along an ascending portion of the contoured edge, the needle will be driven upwards, and when the needle moves along a descending portion of the contoured edge, the needle will move back down.

Continuing with FIG. 4, a knitting-body cover 14 may be provided to at least partially cover the opening to the interior chamber 46 of the knitting body 12 and restrict access to the plurality of needles 50. The knitting-body cover 14 may be coupled to the knitting body 12 via a hinge or other mechanism to permit partial uncoupling of the knitting-body cover 14. In FIG. 4, the knitting-body cover 14 is shown in an open position, allowing access to the interior chamber 46 and the plurality of needles 50. A first surface 62 of the knitting body 12 at the material-insertion end 24 may include ribs that generally correspond to the shape of an engaging edge 65 of the knitting-body cover 14 that will contact with the first surface 62 when closed. The engaging edge 65 may also include at least one projection 66 that aligns with at least one groove 68 in the first surface 62 of the knitting body 12 when the knitting-body cover 14 is closed. In the embodiment depicted, there are three projections 66 and three grooves 68. When the knitting-body cover 14 is closed, the projections 66 may engage with the grooves 68 to keep the knitting-body cover 14 in the closed position.

In one aspect, at least one of the grooves 68 may include a sensor 70. The sensor 70 may work as a safety feature to prevent access to the plurality of needles during rotation. When the knitting-body cover 14 is closed, a projection 66 is engaged with a groove 68 having a sensor 70, and rotation of the needle holder 48 is permitted. When the knitting-body cover 14 is open, the sensor 70 does not sense a projection 66 engaged in the groove 68, and rotation of the needle holder 48 cannot be initiated. This safety feature may help keep users from being injured by the rotating needles 50. In one embodiment, the sensor 70 may be any sensor configured to detect the closure of the knitting-body cover 14, such as a capacitive touch sensor or a mechanically depressed sensor. Additionally, while described with respect to a projection feature and groove, additional embodiments of the invention include recessed, embossed, or flush-mounted sensors and triggering objects that generate a corresponding indication of closure for permitting automated rotation. As such, a sensor mechanism may be coupled to one or both of the knitting-body cover 14 and the knitting body 12, providing an indication of an open state or a closed state of the device.

Accordingly, the sensor 70, may work to prevent the automated motor to turn off when the knitting-body cover 14 is open but does not prevent manual rotation of the needle holder 48 when the knitting-body cover 14 is open. However, because manual rotation will likely occur at a slower rate than the automated knitting rate, the risk of injury caused by manual rotation when the knitting-body cover 16 being open is not as great. Additionally, user manipulation of the knitting strand 30 during manual rotation may be useful when starting the knitted structure 60. As such, the sensor 70, in accordance with an aspect, prevents automated rotation but not manual rotation when the knitting-body cover 14 is open. In other words, a user may manually manipulate the knitting strand 30 into engagement with one or more of the needles, prior to closing the knitting-body cover 14 and beginning the automated knitting process once the knitting-body cover 14 is closed.

In some embodiments, a top surface of the knitting-body cover 14 may include a cover opening 72 through which the knitting strand 30 may run to reach the interior chamber 46 of the knitting body 12. The cover opening 72 may include an annular portion 74 and a straight portion 76. The annular portion 74 may correspond in shape and size to the center aperture 52 of the needle holder 48. When the knitting-body cover 14 is closed over the knitting body 12, the annular portion 74 may vertically align with the center aperture 52 such that an object inserted through the annular portion 74 of the cover opening 72 may easily be inserted into the center aperture 52.

The straight portion 76 of the cover opening 72 may extend from the annular portion 74 towards the back side of the knitting-body cover 14 and, though not shown in FIG. 4, may continue down the back surface of the knitting-body cover 14. The end of the straight portion 76 opposite of the annular portion 74 may align with the thread feeder 54 on the knitting body 12. Accordingly, a knitting strand 30 may be fed into the interior chamber 46 of the knitting body 12 through the straight portion 76 of the cover opening 72 while the knitting-body cover 14 remains coupled to the knitting body 12. Further, the straight portion 76 and the annular portion 74 of the cover opening 72 may permit a user to manipulate the placement of the knitting strand 30 on the plurality of needles 50 while the knitting-body cover 14 is closed by pulling up on the knitting strand 30 and sliding the knitting strand 30 down the straight portion 76 to the annular portion 74.

Figure 5:
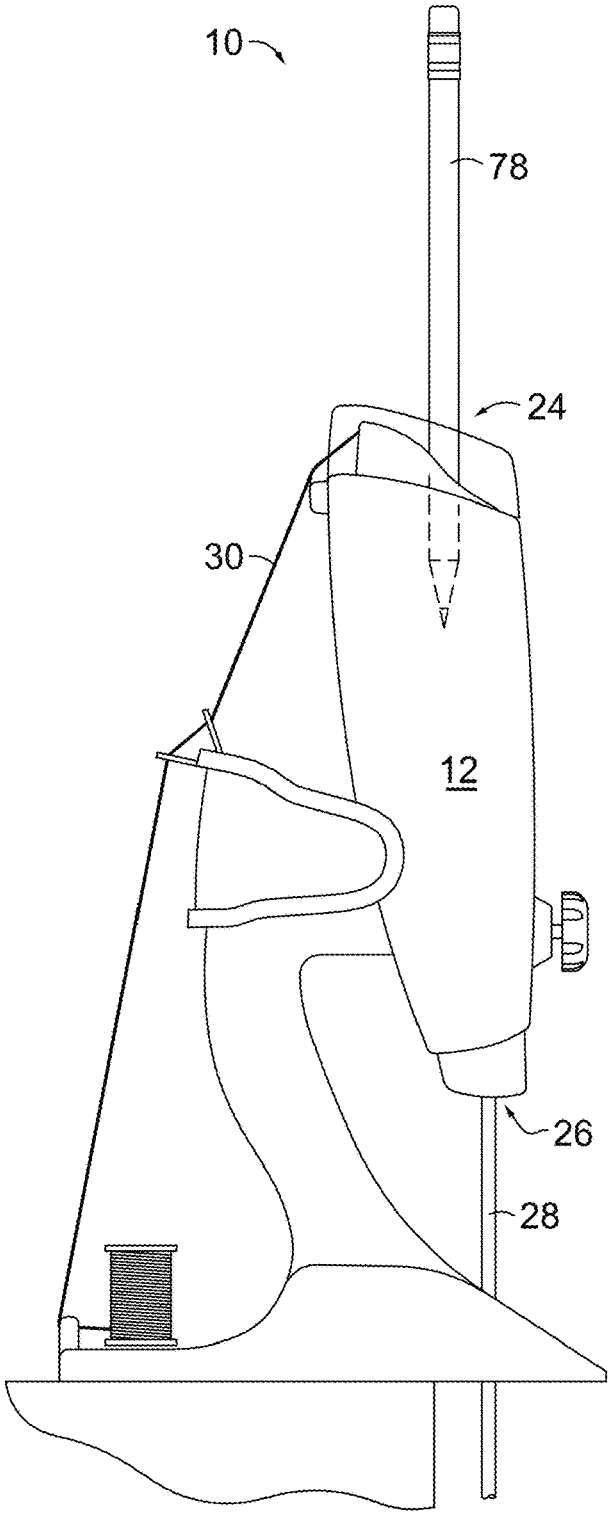
FIG. 5 is a side view of the knitting device of FIG. 1 with an embellishment inserted into the knitting device, in accordance with an embodiment of the invention.
Figure 6:
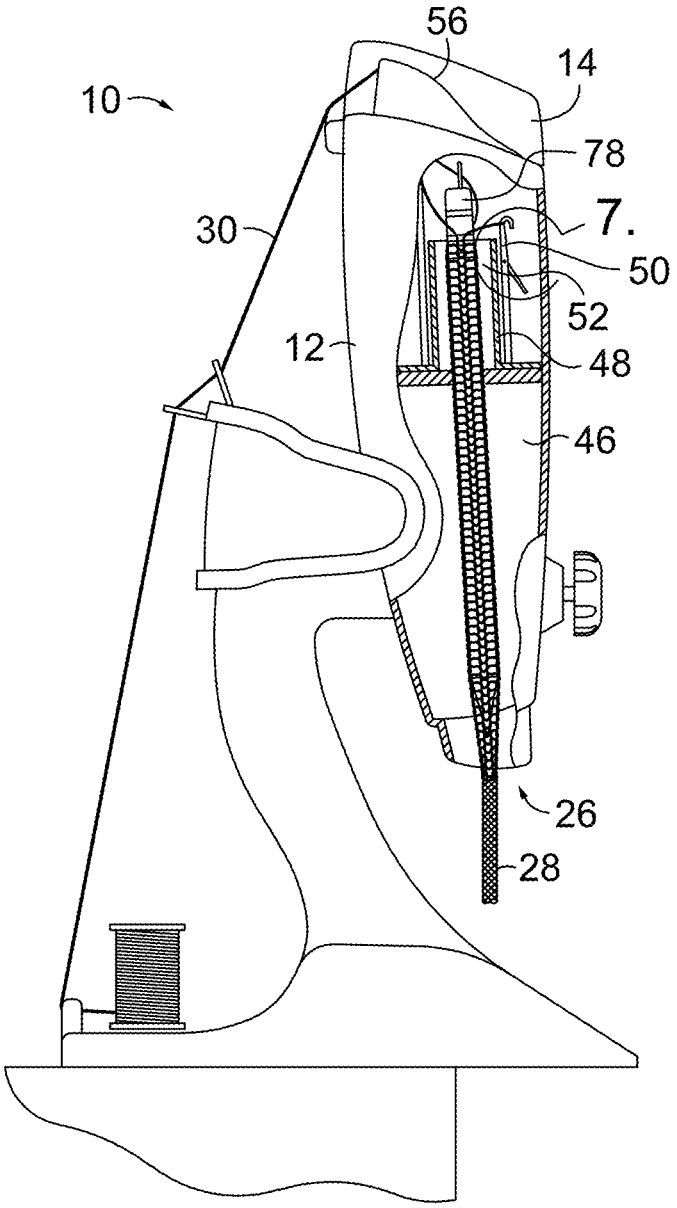
FIG. 6 is a side view of the knitting device of FIG. 1, with a portion cut away to show an embellishment traveling through the knitting device, in accordance with an embodiment of the invention.

The annular portion 74 of the cover opening 72 may also be used to incorporate embellishments or other objects into the knitted product 28. The knitted product 28 may be a circular-knit, cord-like structure, such as an i-Cord, with a hollow interior. In one aspect, an embellishment may be incorporated into the hollow interior of the knitted product 28 while the knitted product 28 is being formed. The knitting strand 30 used to make the knitted product 28 may be knitted around the surface of the inserted embellishment. As shown in FIGS. 5-6, various embellishments and other items, such as a pencil, may be embedded within the hollow interior of the knitted product 28 while the knitted product 28 is being formed. In some aspects, an embellishment having dimensions that fit within the diameter of interior chamber 46 of the knitting body 12 may be incorporated into a knitted product 28 based on inserting the embellishment into the upper end of the knitting body, and retrieving the knit-covered embellishment as part of the finished knitted product 28. The embellishment may be a solid item, a hollow item, a pliable item, or any other structure that is separate from the knitting strand 30 but incorporated inside of the knitted stitches. For example, an integrated embellishment may include a mesh chamber having a hollow interior, like a cylindrical shaft of mesh tubing, for knitting a surrounding structure and providing a knit-covered cylindrical structure. Similarly, a pencil having a generally cylindrical shape but a solid structure may have a knitted structure constructed around it, as described below.

As shown in FIG. 5, in one aspect, a pencil 78 is being inserted into the knitting body 12 from the material-insertion end 24. Specifically, the pencil 78 may be inserted through the annular portion 74 of the cover opening 72 and straight down through the center aperture 52 of the needle holder 48 and into the interior chamber 46 of the knitting body 12. In FIG. 5, the dashed lines on the pencil 78 represent the portion of the pencil 78 that has been inserted into the interior chamber 46. Further, as shown in FIG. 5, the pencil 78 may be inserted into the knitting body 12 while the knitted product 28 is being discharged from the knitting body 12.

By inserting the pencil 78 through the center aperture 52 and into the interior chamber 46 of the knitting body 12, the pencil 78 may be embedded within the knitted product 28, as shown in FIG. 6. Specifically, as the pencil 78 is inserted through the center aperture 52, the pencil 78 is inserted into the hollow interior of the knitted product 28 that is being created by the plurality of needles 50 around the pencil 78. As the pencil 78 continues to be embedded within the knitted product 28, it may be discharged with the knitted product 28 out of the knitting body 12 at the material-exit end 26.

Because the pencil 78 must travel through the annular portion 74 of cover opening 72 and the center aperture 52, the annular portion 74 and the center aperture 52 may both have diameters sufficient to accommodate the pencil 78. For instance, if the diameter of the pencil 78 is about 0.25 inches, the diameters of the annular portion 74 and the center aperture 52 may be at least 0.25 inches. Additionally, because the pencil 78 is inserted through the center aperture 52 with the knitted structure 60, the diameter of the center aperture 52 may be sufficient to accommodate the knitted structure 60 as well as the pencil 78. In some embodiments, the center aperture 52 has a diameter between 0.25 inches and 0.5 inches. In other embodiments, the diameter of the center aperture 52 may fall outside of this range based on the diameter of various embellishments to be used with the knitting device 10.

As can be seen in FIG. 6, the needle holder 48 may be positioned in the interior chamber 46 of the knitting body 12 such that the needles 50 are below the raised edge 56 of the knitting body 12 surrounding the opening to the interior chamber 46. The lowered position of the needles 50 with respect to the raised edge 56 of the knitting body 12 may help protect the needles 50 from the outside environment and protect a user from accidently injuring himself while the needles 50 are rotating. The low positioning may also make it difficult for a user to manipulate the knitting strand 30 around the needles 50 when needed. Therefore, the raised edge 56 may be contoured such that at least a portion of the raised edge 56 is lower, allowing easier access to the needles 50.

Figure 7:
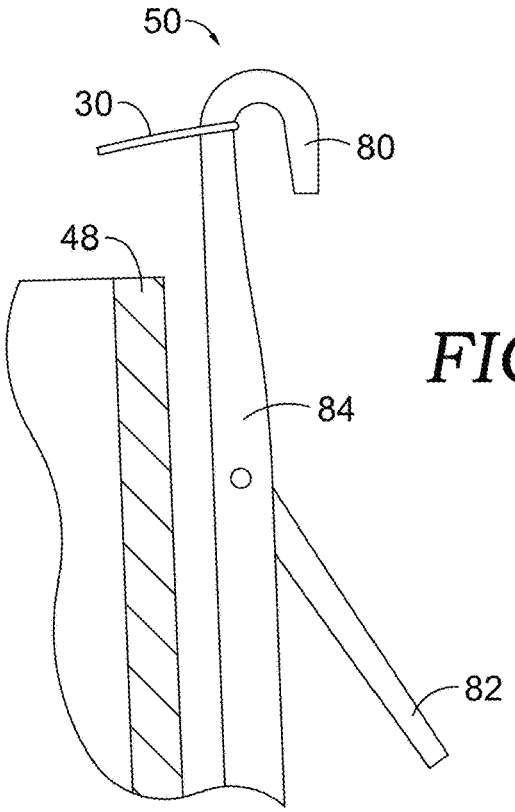
FIG. 7 is an expanded, side view of a knitting needle of the knitting device taken at reference circle 7 in FIG. 6, in accordance with an embodiment of the invention.
Figure 8:
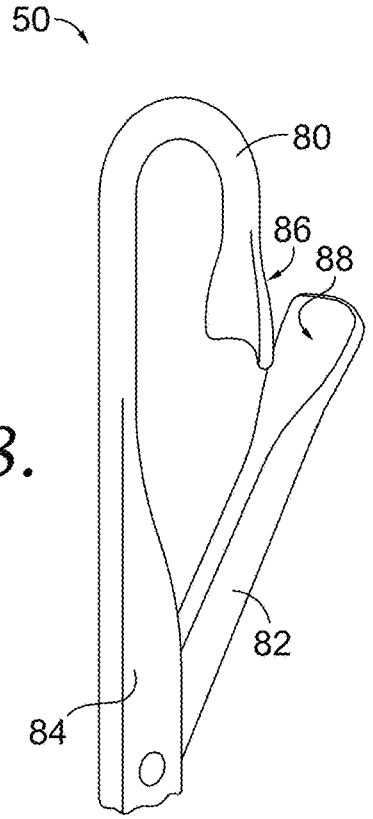
FIG. 8 is an expanded, perspective view of the knitting needle of FIG. 7, in accordance with an embodiment of the invention.

Turning to FIGS. 7-8, expanded views of the needle 50 taken at reference circle 7 in FIG. 6 are provided. The needle 50 may include a hook 80, a latch 82, and a shaft 84. The hook 80 may form one end of needle 50 and may be used to hook a loop formed by the knitting strand 30 on the needle 50. Continuing from the hook 80 may be the shaft 84 of the needle on which the latch 82 is coupled. The latch 82 may be configured to rotate partially around the point at which it connects to the shaft 84. When the latch 82 pivots in one direction, it may be raised towards the hook 80 to form a closed loop with the hook 80, and the latch 82 may pivot in the opposite direction to be lowered down away from the hook 80. Loops in the knitting strand 30 are knitted together by the closing and opening of the latch 82 with respect to the hook 80.

The hook 80 and the latch 82 may have pointed ends, such as those on a traditional latched knitting needle. In another embodiment, such as the one illustrated in FIG. 8, however, the ends of the hook 80 and the latch 82 that meet together may be curved. Specifically, the latch-facing surface 86 on the end of the hook 80 and the hook-facing surface 88 on the latch 82 may be curved. In one embodiment, the latch-facing surface 86 on the hook 80 is convex with respect to the latch 82 while the hook-facing surface 88 on the latch 82 is concave with respect to the hook 80, such that the curved latch-facing surface 86 of the hook 80 can rest within the curved hook-facing surface 88 of the latch 82 when the latch 82 and hook 80 meet. Further, the edges of the curved portions of the hook 80 and latch 82 may be rounded.

Utilizing curved ends and rounded edges on the hook 80 and latch 82 may decrease the risk of injury when using the knitting device 10.

Figure 9:
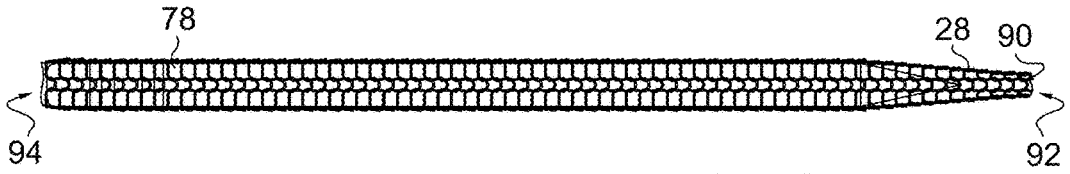
FIG. 9 is a side view of a knitted product created with the knitting device with a pencil in the hollow interior of the knitted product, in accordance with an embodiment of the invention.
Figure 10:
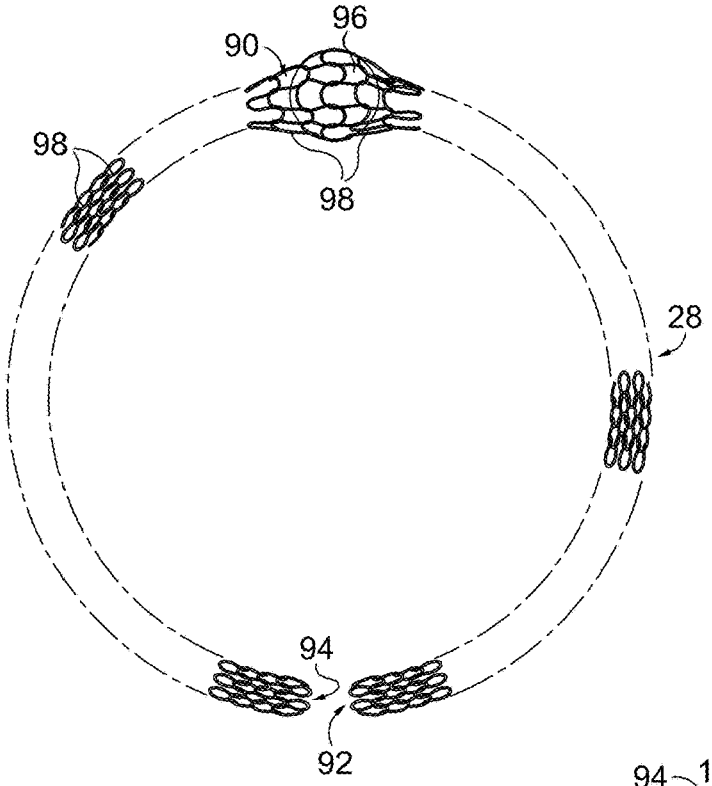
FIG. 10 is a side view of a knitted product with an embellishment in the hollow interior of the knitted product, in accordance with an embodiment of the invention.
Figure 11:
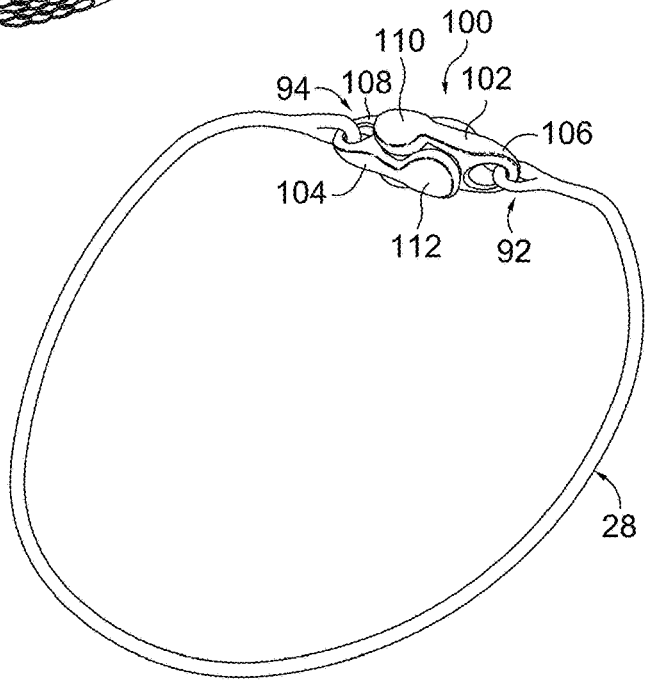
FIG. 11 is a perspective view of a knitted product with a breakaway clasp, in accordance with an embodiment of the invention.

FIGS. 9-11 provide various products that can be created with use of the knitting device 10. As previously discussed, an embodiment of the knitting device 10 may be configured to knit the knitted product 28 around a pencil 78 inserted into the knitting device 10. The knitted product 28 may include a first end 92, a second end 94, and a hollow interior 90 between the first end 92 and the second end 94. The pencil 78 may be removed by sliding the pencil 78 out of the hollow interior 90 of the knitted product 28 at either the first end 92 or the second end 94.

Similarly, an embellishment 96 may be embedded within the hollow interior 90 of the knitted product 28, as shown in FIG. 10. The embellishment 96 may comprise various objects such as a bead, a marble, and the like. The embellishment 96 may be inserted into the hollow interior 90 of the knitted product 28 in the same manner as the pencil 78, discussed above. Accordingly, the annular portion 74 of the cover opening 72 and the center aperture 52 of needle holder 48 may be of sufficient diameters to accommodate the diameter of the embellishment 96 with the knitting strand 30.

FIG. 10 shows only select portions of the knitted structure of the knitted product 28 for purpose of clarity, but it is contemplated that the knitted structure continues throughout the entirety of the knitted product 28. The knitted structure of the knitted product 28 comprises a plurality of openings 98 between the strands enclosing the hollow interior 90. By inserting an embellishment 96 into the hollow interior 90 of the knitted product 28, the embellishment 96 may cause the openings 98 to enlarge compared to openings 98 that are not near the embellishment 96. Yet, the embellishment 96 may be of sufficient size that it cannot exit the hollow interior 90 of the knitted product 28 via a transverse direction with respect to the length of the knitted product 28. In other words, the embellishment 96 may not escape through the openings 98 in the knitted product 28 and may be removed from the hollow interior 90 only at the first end 92 or the second end 94.

Continuing with FIG. 11, the knitted product 28 may also be used with a breakaway clasp 100 to releasably couple together a first end 92 and a second end 94 of the knitted product 28. The breakaway clasp 100 may include a first clasp component 102 and a second clasp component 104, and the first clasp component 102 and the second clasp component 104 may be releasably coupled together to form the breakaway clasp 100.

Figure 12:
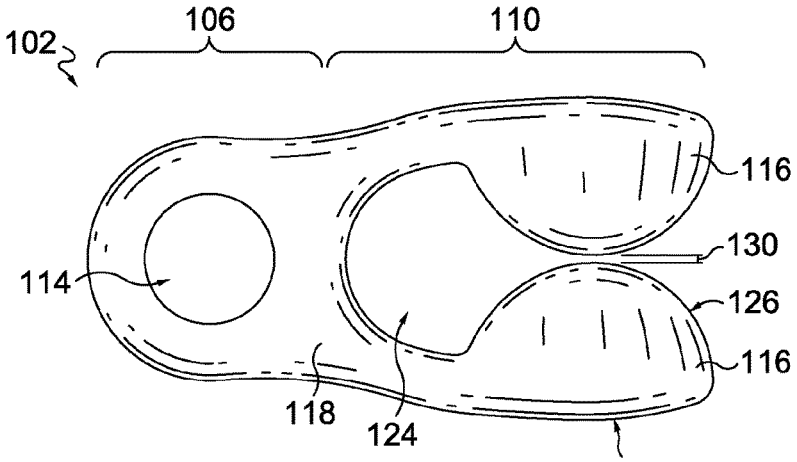
FIG. 12 is an expanded side view of a clasp component of the breakaway clasp of FIG. 11, in accordance with an embodiment of the invention.
Figure 13:
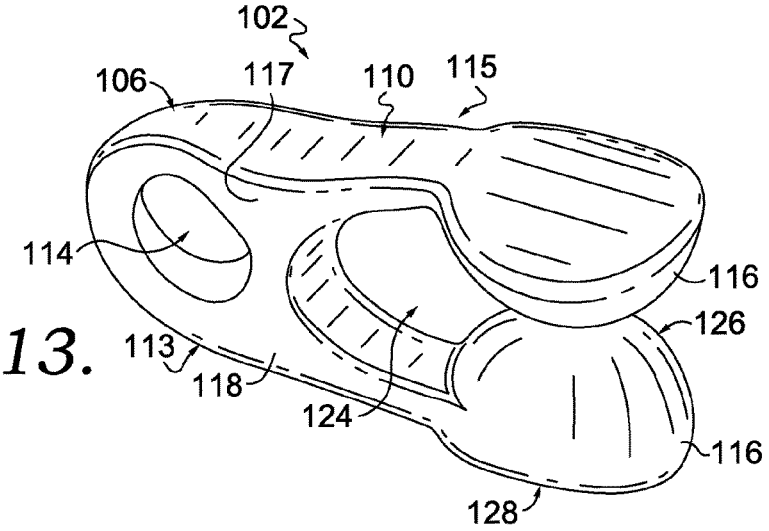
FIG. 13 is an expanded perspective view of the clasp component of FIG. 12, in accordance with an embodiment of the invention.
Figure 14:
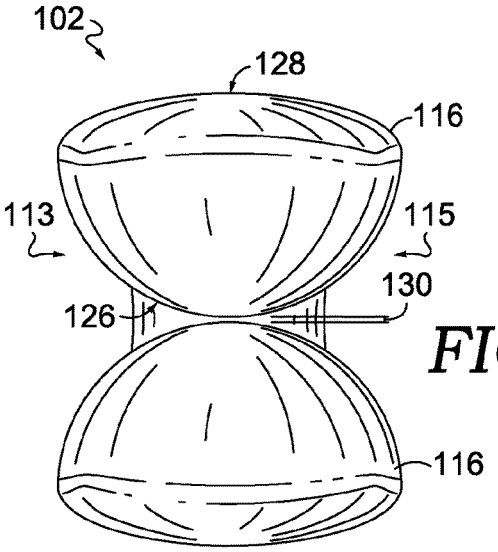
FIG. 14 is a front view of the clasp component of FIG. 12, in accordance with an embodiment of the invention.

FIGS. 12-14 provide various views of the first clasp component 102. In one embodiment, the first clasp component 102 may be identical in shape and size to the second clasp component 104. Accordingly, the discussion of the first clasp component 102 as shown in FIGS. 12-14 may be also be applicable to the second clasp component 104.

The first clasp component 102 may comprise an attachment portion 106 configured to attach the first clasp component 102 to an article, such as the knitting product 28, and a coupling portion 110 configured to couple the first clasp component 102 to another clasp component, such as the second clasp component 104. Accordingly, as shown in FIG. 11, the attachment portion 106 of the first clasp component 102 may be attached or coupled to the first end 92 of the knitted product while an attachment portion 108 of the second clasp component 104 may be attached or coupled to the second end 94 of the knitted product 28. Additionally, the coupling portion 110 of the first clasp component 102 may be releasably coupled to a coupling portion 112 of the second clasp component 104 to form a clasp, or a closure mechanism, for the knitted product 28. In this way, the breakaway clasp 100 may be used to couple ends of the knitted product 28 together to form wearable jewelry, such as a necklace, bracelet, and the like. It is also contemplated, however, that the clasp may be used as a closure mechanism for jewelry items other than the knitted product 28 and for articles other than jewelry, such as garments, bags, purses, and the like.

Figure 15:
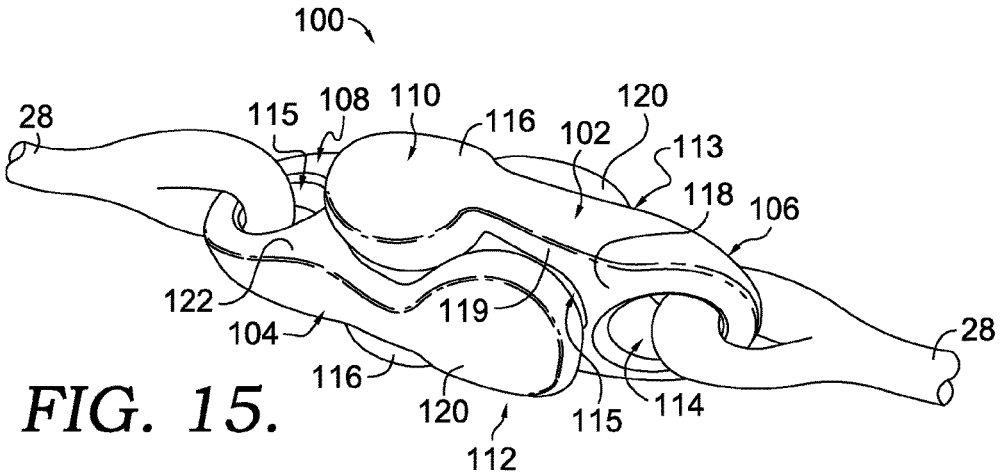
FIG. 15 is an expanded, perspective view of the breakaway clasp of FIG. 11, in accordance with an embodiment of the invention.
Figure 16:
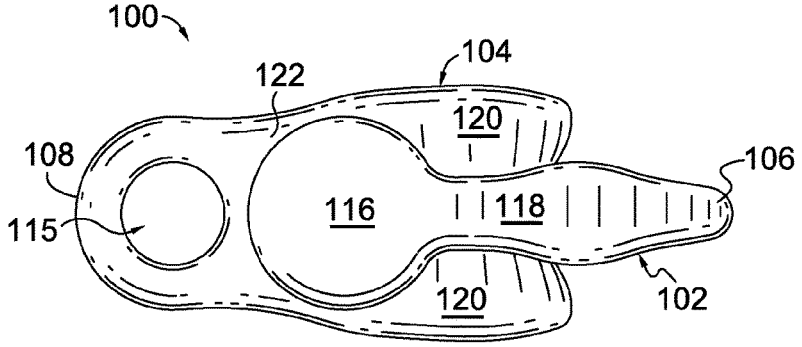
FIG. 16 is an expanded, side view of the breakaway clasp of FIG. 11, in accordance with an embodiment of the invention.
Figure 17:
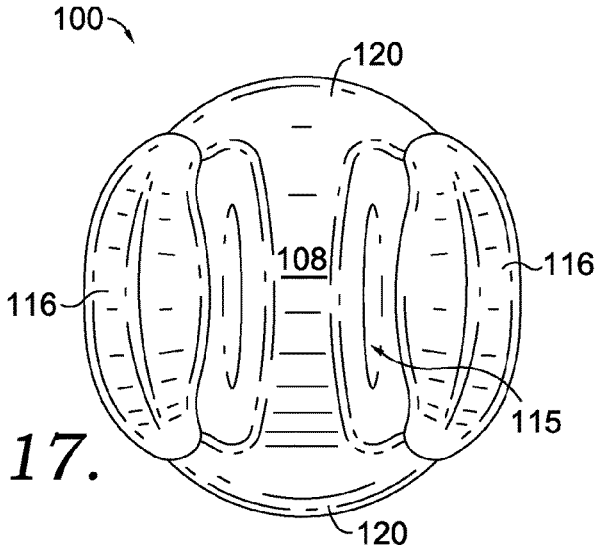
FIG. 17. is an expanded, rear view of the breakaway clasp of FIG. 11, in accordance with an embodiment of the invention.

Turning back to FIGS. 12-14, in some embodiments, the attachment portion 106 of the first clasp component 102 may comprise a clasp opening 114. As illustrated, the clasp openings 114 may be circular, but it is contemplated that the clasp openings 114 may comprise various other shapes, such as ovals, triangles, squares, and the like. Portions of an article that are to be releasably coupled together using the breakaway clasp 100 may be permanently or releasably secured to the attachment portion 106 via the clasp opening 114. For example, the first end 92 of the knitted product 28 may be looped through the clasp opening 114 and tied or otherwise secured together to attach the knitted product 28 to the first clasp component 102. It is contemplated that there may be additional methods of coupling an article, such as the knitted product 28, to the first clasp component 102. Additionally, as seen in FIGS. 15-17, the second clasp component may have a clasp opening 115 similar in shape and/or size to the clasp opening 114 of the first clasp component 102; however, in other aspects, the shape and/or size of the clasp openings of mating clasp components, such as the first clasp component 102 and the second clasp component 104, may be different.

The coupling portion 110 of the first clasp component 102 comprises a U-shape configuration with two hemisphere elements 116 connected by a connecting section 118. In some aspects, the two hemisphere elements 116 may each comprise an inward-facing surface 126 and an outward-facing surface 128. The inward-facing surfaces 126 of the hemisphere elements 116 face inwards or towards each other. In this way, the inward-facing surface 126 of a first hemisphere element 116 may be proximate to the inward-facing surface 126 of a second hemisphere element 116. As illustrated in FIGS. 12-14, the hemisphere elements 116 may be convex such that the inward-facing surfaces of the hemisphere elements 116 extend towards each other. In some aspects, the apexes of the curvatures of the inward-facing surfaces 126 of the hemisphere elements 116 are spaced apart by a threshold distance 130. In some aspects, the threshold distance 130 is a minimal distance such that the two hemisphere elements 116 are nearly touching when the first clasp component 102 is not coupled to another clasp component. For instance, the threshold distance 130 may be approximately two millimeters. In other aspects, the threshold distance 130 may be in a range of approximately one millimeter to three millimeters, and in other aspects the threshold distance 130 may be outside that range. In other aspects, the threshold distance 130 is zero such that the two hemisphere elements 116 are touching when the first clasp component 102 is not coupled to another clasp component.

In some aspects, the outward-facing surfaces 128 of the hemisphere elements 116 are opposite of the inward-facing surfaces 128. The outward-facing surfaces 128 may be flat, substantially flat, or have a lesser degree of curvature than the inward-facing surfaces 126. In other aspects, outer-facing surfaces 128 have a curvature substantially equal to the curvature of the inward-facing surfaces 126. Accordingly, the two hemisphere elements 116 may comprise a various shapes, including a hemisphere, sphere, ellipsoid, and the like.

In addition to the two hemisphere elements 116, the coupling portion 110 of the first clasp component 102 may include a connecting section 118 that connects the two hemisphere elements 116 together. The connecting section 118 may include a first end coupled to the one hemisphere element 116 and a second end coupled to the other hemisphere element 116. The ends of the connecting section 118 may be coupled to or attach to portions of the hemisphere elements 116 that are transitions between the inward-facing surfaces 126 and the outward-facing surfaces 128. In some aspects, the connecting section 118 is curved or U-shaped. In this way, the connecting section 118 may form a hinge between the two hemisphere elements 116, and the hinge may open such that the hemisphere elements 116 may be spaced apart a greater distance but still able to return to their original positions. The connecting section 118 comprises a first curved surface 117 on a first side 113 of the first clasp component 102 (as visible in FIG. 13), and a second curved surface 119 on the second side 115 of the first clasp component 102 opposite the first side 113 (as visible in FIG. 15). extending from the first end, to the clasp opening 114 and to the second end. As the first curved surface 117 extends from a hemisphere element 116 (such as a first hemisphere element) towards the clasp opening 114, it curves away from the second curved surface 119, and similarly, as the second curved surface 119 extends from the same hemisphere element 116 to the clasp opening 114, it curves away from the first curved surface 117. Additionally, the connecting section 118 and at least a portion of each of the two hemisphere elements 116 may define a receiving cavity 124 of the first clasp component 102. The receiving cavity 124 may be configured to receive at least part of the hemisphere elements on another clasp element.

When coupled to an identical clasp component, the hemisphere elements 116 of the first clasp component 102 may be frictionally engaged with the other clasp component via the other clasp component's receiving cavity. For example, FIGS. 15-17 illustrate the first clasp component 102 releasably coupled with the second clasp component 104. When coupled together, the second clasp component 104 may be oriented 90 degrees relative to the orientation of the first clasp component 102. The hemisphere elements 116 of the first clasp component 102 at least partially fill the receiving cavity of the second clasp component 104 while two hemisphere elements 120 of the second clasp component 104 at least partially fill the receiving cavity of first clasp element 102. In this manner, the hemisphere elements 116 of the first clasp component 102 engage with the connecting section 122 and the hemisphere elements 120 of the second clasp component, and the hemisphere elements 120 of the second clasp component engage with the connecting section 118 and the hemisphere elements 116 of the first clasp component 102.

In order to couple the first clasp component 102 with the second clasp component 104, some force may be applied so that the hemisphere elements 116 of the first clasp component 102 are moved away from one another and the hemisphere elements 120 of the second clasp component 104 are moved away from one another to allow for the hemisphere elements 116 and 120 to be fitted into their respective receiving cavities. Accordingly, this may be done by pushing together the hemisphere elements 116 of the first clasp component and the hemisphere elements 120 of the second clasp component. In some aspects, the hemisphere elements 116 and 120 may snap into their respective receiving cavities with a small amount of force. During this process, the distance between the inward-facing surfaces 126 of the hemisphere elements 116 may expand beyond the threshold distance 30, but the hemisphere elements 116 may move back towards one another when fitted into the receiving cavities. In some aspects, the inward-facing surfaces 126 of the hemisphere elements 116 maintain the threshold distance 30 when coupled to the second clasp component 104; however, in other aspects, the inward-facing surfaces 126 of the hemisphere elements 116 are separated by a distance greater than the threshold distance when coupled to the second clasp component 104. Because the second clasp component 104 may be identical to the first clasp component 102, the hemisphere elements 120 of the second clasp component 104 may behave in a similar manner during the coupling process.

The curvature of the hemisphere elements 116 and 120 helps to keep the first and second clasp components 102 and 104, respectively, frictionally engaged with one another so that they do not uncoupled too easily or inadvertently. However, the first and second clasp components 102 and 104, respectively, may be configured to uncouple upon application of some amount of force. In one embodiment, a user may use a small amount of force to pull apart and uncouple the first and second clasp components 102 and 104, respectively. Similar to the coupling process, the hemisphere elements 116 and hemisphere elements 120 may move apart from one another during the uncoupling process and then may move back towards one another once uncoupled. Because the first and second clasp components 102 and 104, respectively, may be uncoupled using only a small amount of force, the breakaway clasp 100 may provide a quick release closure that is suitable for children's jewelry. Specifically, compared to traditional clasps, the breakaway clasp 100 may provide a level of ease of use that is more appropriate for children. Additionally, the breakaway clasp 100 may be uncoupled more easily and quickly than traditional clasps, which may decrease the risk of an injury if an article, such as a necklace, becomes two tight when worn.

The breakaway clasp 100 may be constructed from a variety of materials. Exemplary materials include materials with some flexibility to allow the first clasp component 102 and the second clasp component 104 to couple and uncouple to one another using a small amount of force but with sufficient rigidity that the two clasp components 102 and 104 do not become uncoupled without a user pulling them apart. Such materials may include a thermoplastic polyurethane or a rubber material such as natural rubber, butadiene rubber, ethylene propylene rubber, and the like.

In one embodiment of the invention, a knitting kit may include a knitting device 10 and at least one breakaway clasp 100. The knitting kit may also include at least one material for the knitting strand 30 and/or at least one embellishment or object to be embedded within the knitted product 28. Various other accessories of the knitting device 10 or the knitted product 28 created by the knitting device 10 may be included in the kit.

Many different arrangements of the various components depicted, as well as components not shown, are possible without departing from the scope of the claims below. Embodiments of the technology have been described with the intent to be illustrative rather than restrictive. Alternative embodiments will become apparent to readers of this disclosure after and because of reading it. Alternative means of implementing the aforementioned can be completed without departing from the scope of the claims below. Certain features and subcombinations are of utility and may be employed without reference to other features and subcombinations and are contemplated within the scope of the claims.

The invention claimed is:

1. A breakaway clasp, the clasp comprising:

a first clasp component having a coupling portion and an attachment portion; and a second clasp component having a coupling portion and an attachment portion, wherein each attachment portion comprises a clasp opening and is configured to be coupled to a portion of an article via the clasp opening, and wherein each coupling portion is configured to releasably couple the first clasp component to the second clasp component, each coupling portion comprising a first hemisphere element, a second hemisphere element, and a curved connecting section that connects the first and second hemisphere elements, wherein the first hemisphere element, the second hemisphere element, and the connecting section define a receiving cavity, wherein each connecting section comprises a first curved surface on a first side of the connecting section and a second curved surface on a second side of the connecting section opposite the first side, wherein the first curved surface and the second curved surface each extend from the first hemisphere element toward the clasp opening, and wherein the first curved surface curves away from the second curved surface as the first curved surface extends from the first hemisphere element towards the clasp opening, and wherein the second curved surface curves away from the first curved surface as the second curved surface extends from the first hemisphere element towards the clasp opening.

2. The breakaway clasp of claim 1, wherein when the first clasp component is coupled to the second clasp component, the first and second hemisphere elements of the first clasp component at least partially fill the receiving cavity of the second clasp component, and the first and second hemisphere elements of the second clasp component at least partially fill the receiving cavity of the first clasp component.

3. The breakaway clasp of claim 1, wherein the coupling portion of the first clasp component is identical in size and shape to the coupling portion of the second clasp component.

4. The breakaway clasp of claim 1, wherein, when coupled together along a common longitudinal axis, the first coupling portion is oriented 90 degrees relative to the second coupling portion.

5. The breakaway clasp of claim 1, wherein the first clasp component and the second clasp component are configured to releasably couple a first end of a jewelry strand to a second end of a jewelry strand, wherein an amount of force applied to the jewelry strand separates the first clasp from the second clasp.

6. The breakaway clasp of claim 1, wherein the first clasp component and the second clasp component comprise a thermoplastic material.

7. A universal clasp component comprising:

a first hemisphere element;

a second hemisphere element;

a curved connecting section connecting the first hemisphere element and the second hemisphere element, and an attachment portion adjacent the connecting section, the attachment portion comprising a clasp opening and being configured to attach the universal clasp component to an article via the clasp opening, wherein at least a portion of the first hemisphere element, at least a portion of the second hemisphere element, and the curved connecting section define a receiving cavity configured to receive at least a portion of a second universal clasp component, wherein the curved connecting section comprises a first curved surface on a first side of the curved connecting section and a second curved surface on a second side of the curved connecting section opposite the first side, wherein the first curved surface and the second curved surface each extend from the first hemisphere element toward the clasp opening, and wherein the first curved surface curves away from the second curved surface as the first curved surface extends from the first hemisphere element towards the clasp opening, and wherein the second curved surface curves away from the first curved surface as the second curved surface extends from the first hemisphere element towards the clasp opening.

8. The universal clasp component of claim 7, wherein the first hemisphere element comprises an inward-facing surface and an outward-facing surface and the second hemisphere element comprises an inward-facing surface and an outward-facing surface, the first hemisphere element and the second hemisphere element being oriented such that the inward-facing surface of the first hemisphere element is facing the inward-facing surface of the second hemisphere element.

9. The universal clasp component of claim 8, wherein the inward-facing surface of the first hemisphere element and the inward-facing surface of the second hemisphere element each comprise a convex curvature.

10. The universal clasp component of claim 9, wherein an apex of the convex curvature of the inward-facing surface of the first hemisphere element and an apex of the convex curvature of the inward-facing surface of the second hemisphere are spaced apart at a threshold distance when uncoupled to the second universal clasp component.

11. The universal clasp component of claim 10, wherein the first hemisphere element and the second hemisphere element are configured to move away from each other when the universal clasp component is being coupled to the second universal clasp component such that a distance between the apex of the convex curvature of the inward-facing surface of the first hemisphere element and the apex of the convex curvature of the inward-facing surface of the second hemisphere is greater than the threshold distance during coupling.

12. The universal clasp component of claim 8, wherein the outward-facing surface of the first hemisphere element has a lesser curvature than the inward-facing surface of the first hemisphere element and the and the outward-facing surface of the second hemisphere element has a lesser curvature than the inward-facing surface of the second hemisphere element.

13. A symmetrical clasp component for a closure mechanism, the symmetrical clasp component comprising:

a first hemisphere element;

a second hemisphere element opposite the first hemisphere element, the first hemisphere element and the second hemisphere element each comprising a convex shape and extending towards one another;

a curved connecting section having a first end connected to the first hemisphere element and a second end connected to the second hemisphere element, the connecting section forming a hinge between the first hemisphere element and the second hemisphere element; and an attachment portion adjacent the connecting section, the attachment portion comprises an opening, wherein the first hemisphere element comprises a mirror image of the second hemisphere element, wherein at least a portion of the first hemisphere element, at least a portion of the second hemisphere element, and the curved connecting section define a receiving cavity, and wherein the connecting section comprises a first curved surface on a first side of the connecting section and a second curved surface on a second side of the connecting section opposite the first side, wherein the first curved surface and the second curved surface each extend from the first hemisphere element toward the clasp opening and wherein, the first curved surface curves away from the second curved surface as the first curved surface extends from the first hemisphere element towards the clasp opening, and wherein the second curved surface curves away from the first curved surface as the second curved surface extends from the first hemisphere element towards the clasp opening.

14. The symmetrical clasp component of claim 13, wherein an inward-facing surface of the first hemisphere element and an inward-facing surface of the second hemisphere element are spaced apart by a threshold distance.

15. The symmetrical clasp component of claim 14, wherein the connecting section is configured to hinge open such that the inward-facing surface of the first hemisphere element is spaced from the inward-facing surface of the second hemisphere element by a distance greater than the threshold distance.

16. The symmetrical clasp component of claim 13, wherein the opening in the attachment portion adjacent is a circular opening.

* * * * *